United States Patent [19]

Sweeney

[11] Patent Number: 4,539,014

[45] Date of Patent: Sep. 3, 1985

[54] LOW FLASH POINT DIESEL FUEL OF INCREASED CONDUCTIVITY CONTAINING AMYL ALCOHOL

[75] Inventor: William M. Sweeney, Wappingers Falls, N.Y.

[73] Assignee: Texaco Inc., White Plains, N.Y.

[21] Appl. No.: 183,507

[22] Filed: Sep. 2, 1980

[51] Int. Cl.[3] ..... C10L 1/18

[52] U.S. Cl. ..... 44/56; 44/57

[58] Field of Search ..... 44/56, 57, DIG. 2

[56] References Cited

U.S. PATENT DOCUMENTS

| | | | |
|---|---|---|---|
| 12,936 | 5/1855 | Gesner | 44/56 |
| 12,987 | 5/1855 | Gesner | 44/56 |
| 38,015 | 3/1863 | Tyler | 44/56 |

*Primary Examiner*—Mrs. Y. Harris-Smith

*Attorney, Agent, or Firm*—Robert A. Kulason; Carl G. Seutter

[57] ABSTRACT

Conductivity of a low flash point diesel fuel containing diluent naphtha is increased by addition thereto of an amyl alcohol, typically a fusel oil.

11 Claims, No Drawings

LOW FLASH POINT DIESEL FUEL OF INCREASED CONDUCTIVITY CONTAINING AMYL ALCOHOL

FIELD OF THE INVENTION

This invention relates to treatment of fuels to increase their conductivity. More particularly it relates to treatment of a low flash point naphtha-extended diesel fuel to increase its conductivity.

BACKGROUND OF THE INVENTION

As is well known to those skilled in the art, it may be desirable to augment the supply of hydrocarbon fuel by adding thereto various components which may not be present therein, to form an extended fuel. Illustrative of such compositions may be a diesel fuel oil which has been extended as by addition thereto of naphtha. The properties of extended fuels are not always equivalent to the fuel from which they are prepared.

It is an object of this invention to provide a fuel composition of desired properties. Other objects will be apparent to those skilled in the art.

STATEMENT OF THE INVENTION

In accordance with certain of its aspects, this invention is directed to a method of increasing the conductivity of an extended hydrocarbon fuel heavier than gasoline which comprises mixing (i) an extended hydrocarbon fuel heavier than gasoline and (ii) as a conductivity additive, at least one pentanol selected from the group consisting of 3-methyl-1-butanol and 2-methyl-1-butanol thereby forming a high conductivity hydrocarbon fuel heavier than gasoline and recovering said high conductivity hydrocarbon fuel heavier than gasoline.

DESCRIPTION OF THE INVENTION

The hydrocarbon fuels heavier than gasoline which may be treated by the process of this invention include those which typically have an initial boiling point (ibp) above about 320° F. Typically such fractions may be identified as kerosene, diesel oil or furnace oil, fuel oil, light gas oil, heavy gas oil, light cycle gas oil, heavy cycle gas oil, vacuum gas oil, etc. These fractions commonly have an initial boiling point above about 340° F. and may have end points as high as 1100° F. They typically have an API gravity below about 40.

In the case of a diesel oil or furnace oil, the fuel may be characterized by an ibp of 325° F.–425° F., an ep of 575° F.–750° F., say 610° F., and an API gravity of 25–50, say 40.

In the case of a vacuum gas oil, the fuel may be characterized by an ibp of 600° F.–700° F., say 650° F., an ep of 900° F.–1100° F., say 1050° F., and an API gravity of 10–35, say 25.

In the case of a typical residual fuel oil, it may be characterized by an API gravity of 5–25, say 20.

In the case of a light cycle gas oil, it may be characterized by an ibp of 300° F.–400° F., say 350° F., an ep of 575° F.–670° F., say 610° F., and an API gravity of 20–40, say 30.

In the case of a heavy cycle gas oil, it may be characterized by an ibp of 500° F.–550° F., say 525° F., an ep of 600° F.–700° F., say 680° F., and an API gravity of 20–35, say 25.

In the case of kerosene, it may be characterized by an ibp of 300° F.–400° F., say 350° F., an ep of 500° F.–600° F., say 550° F. and an API gravity of 30–70, say 50.

Illustrative fuels which may be treated by the process of this invention include (i) a fuel oil having an ibp of 425° F., an ep of 660° F., an API gravity of 30, and a cetane member of 45; or (ii) a kerosene having an ibp of 348° F., and ep of 560° F., and an API gravity of 45.

In order to extend or amplify such hydrocarbon products, typified by a diesel oil, it has been found to be possible to add components which may not normally be present therein. These extenders are commonly added in amount of 2–70 parts, preferably 5–30 parts, say 20 parts per 100 parts of base oil. Where the base oil is for example a diesel oil, it may be possible to add the extender in amount of 2–70 parts, preferably 5–30 parts, say 20 parts per 100 parts of diesel oil.

It is possible to add to the base oil, an extender which may be hydrocarbon or non-hydrocarbon depending upon availability, and upon the use to which the product is to be put.

It is found that diesel oils may be extended by addition thereto of a naphtha. Petroleum naphthas contain a substantial portion of straight chain aliphatics. The ibp is typically 70° F.–140° F., say 110° F.; and the ep is typically 300° F.–425° F., say 350° F. The naphthas may typically have an API gravity of 50–80, say 65.

Other extenders may include gasoline, kerosene, octanes, $C_8$–$C_{12}$ cuts, etc.

The advantages gained by use of such extenders include (i) the augmenting of the fuel supply where local conditions require, (ii) the elimination of fractions such as naphtha which may have little or no use or commercial value in the area, etc.

There are however several attendant disadvantages including the fact that the flash point of the resulting product e.g. diesel fuel may be substantially lowered from e.g. 140° F. for No. 2 diesel oil or 100° F. for kerosene down to 30° F.–75° F. or lower, commonly at or below ambient temperature.

Another disadvantage is the fact that the electric conductivity (in units of picosiemens per meter i.e. pS/m as measured by ASTM Test D-3114) may be undesirably lowered. Typically the conductivity of a diesel oil is about 2–10, say 8 units; and addition of extenders may lower this frequently to as low as 1–7 units say 7. Because of this, there is an increased tendency for static electricity to build up during handling and this may discharge with sparking which can cause ignition, fire, and/or explosion. This static electricity which may build up particularly during pumping of hydrocarbons, or during passage through filters, has in fact been the cause of explosions during handling of low flash point diesel fuel oils.

Another instance of similar problems is that wherein a tanker which has carried gasoline is drained of liquid gasoline and cross-loaded i.e. filled with No. 2 diesel fuel. The resulting static charge generated during filling may cause generation of a spark which may ignite the gasoline fumes remaining in the tank.

It has been found that addition to low flash point hydrocarbon fuels, particularly extended middle distillate fuels such as diesel oils, of amyl alcohols unexpectedly increases the conductivity substantially to a degree sufficient to decrease the formation of static electricity during handling of these materials.

The product compositions are single phase mixtures which do not separate into two phases in the presence of water.

Although it may be possible to utilize all eight of the known amyl alcohols including normal amyl alcohol or mixtures of alcohols, it is preferred to use a pentanol which contains a methyl-1-butanol. A preferred composition may include at least one pentanol selected from the group consisting of 3-methyl-1-butanol and 2-methyl-1-butanol.

It is particularly preferred to utilize commercial mixtures of pentanols such as those identified as crude fusel oil, refined fusel oil, refined amyl alcohol, etc.

Fusel oil is a by-product of the alcoholic fermentation of starches and sugars and is obtained by the redistillation of the crude ethyl alcohol. The proportion of fusel oil is about 0.2 to 1.1% of the ethyl alcohol, and is highest when potatoes are fermented.

Fusel oil is supplied in a crude and a refined grade. Specifications are variable, but typical specifications are given in the following Table:

TABLE

Typical Specification for Fusel Oil and Refined Amyl Alcohol

| Specification | Crude fusel oil | Refined fusel oil | Refined amyl alcohol |
|---|---|---|---|
| Color | Yellow | Water-white | Water-white |
| Odor | strong | Nonresidual | Nonresidual |
| Distn., %: | | | |
| Below 110° C. | — | none | |
| Below 120° C. | — | 15 | |
| Up to 122° C. | 34 | | |
| Below 126° C. | — | | None |
| Below 130° C. | — | Above 60 | |
| Above 132° C. | — | | None |
| 122–138° C. | 61 | — | |
| Above 138° C. | 3.4 | — | |
| $d_{20}^{20}$ | 0.83 | 0.811–0.815 | 0.811–0.815 |
| Acidity as acetic acid, max. % | — | 0.02 | 0.02 |
| Soly. in satd. sodium chloride, % | 9 | — | |
| Ethyl alcohol, % by vol. | 1.7 | — | — |
| Dryness, miscibility with 20 vols. of 60 Be. gasoline at 20° C. | — | no turbidity | no turbidity |
| Nonvolatile matter, max. % | — | 0.006 | 0.003 |

Fusel oil is composed chiefly of 3-methyl-1-butanol (isoamyl alcohol) ca 63% and 2-methyl-1-butanol (levorotatory) ca 11%, together with ethyl ca 1.7%, n-propyl (ca 3–5%), and isobutyl (ca 20%) alcohols, water, and traces of n-butyl alcohol, 1-pentanol, and hexyl and heptyl alcohols. Only primary alcohols are believed to be present. Traces of aldehydes, acids, esters, pyridine, and alkaloids have been reported. The strong residual odor of crude fusel oil is due to some of these nonalcoholic impurities. Refined fusel oil is obtained by chemical treatment and rectification of the crude.

Refined amyl alcohol is produced by a combination of washing, chemical treatment, and distillation. The composition is about 85% 3-methyl-1-butanol and 15% 2-methyl-1-butanol. Specifications are given in the Table supra.

Practice of the process of this invention may include mixing the pentanol composition in conductivity improving amount of 0.01–5 parts, preferably 0.1–1 parts, say 0.2 parts with 100 parts of the base oil. The final composition may thus contain the following:

TABLE

| Component | Broad | Preferred | Narrow |
|---|---|---|---|
| Base oil | 29–100 | 70–100 | 100 |
| Extender | 2–70 | 5–30 | 20 |
| Pentanol | 0.01–5 | 0.1–1 | 0.2 |

Illustrative compositions may include:

| | | | |
|---|---|---|---|
| A | 100 parts | Base oil - Diesel oil | |
| | | ibp | 366° F. |
| | | 50% | 516° F. |
| | | ep | 630° F. |
| | | API | 32.4 |
| | 10 parts | Extender-petroleum naphtha | |
| | | ibp | 90° F. |
| | | 50% | 182° F. |
| | | ep | 320° F. |
| | | API | 70 |
| | 0.7 parts | 3-methyl-1-butanol | |
| B. | 100 parts | Base oil - Diesel oil | |
| | | ibp | 350° F. |
| | | 50% | 491° F. |
| | | ep | 645° F. |
| | | API | 40.2 |
| | 25 parts | Extender-petroleum naphtha | |
| | | ibp | 101° F. |
| | | 50% | 187° F. |
| | | ep | 325° F. |
| | | API | 69 |
| | 1 part | 2-methyl-1-butanol | |
| C. | 100 parts | Base oil - Diesel oil | |
| | | ibp | 363° F. |
| | | 50% | 517° F. |
| | | ep | 628° F. |
| | | API | 35.2 |
| | 5 parts | Extender-petroleum naphtha | |
| | | ibp | 97° F. |
| | | 50% | 179° F. |
| | | ep | 308° F. |
| | | API | 73 |
| | 0.8 parts | refined water-white fusel oil | |
| | | ibp | 110° C. |
| | | 50% | 131 |
| | | ep | 136 |
| | | $d_{20}^{20}$ | 0.80–0.815 |
| | | Acidity as acetic acid (max) | 0.02% |
| | | Non-volatile water (max) | 0.05 |

Comparable formulations may contain No. 2 fuel oil, furnace oils etc. as the base oil.

It is a feature of the process of this invention that the conductivity, as measured by ASTM test D-3114, is unexpectedly increased. Typical untreated extended oils, such as extended diesel fuels, having an initial conductivity of only 1–7, say 7 pS/m may be improved significantly i.e. by 3–10, say 7 units to a value of 12–80, say 15 units.

As will be apparent to those skilled in the art, increases of this magnitude represent a substantial and unexpected improvement.

DESCRIPTION OF PREFERRED EMBODIMENTS

Practice of the process of this invention will be apparent to those skilled in the art from the following wherein, as elsewhere in this specification, all parts are parts by weight unless otherwise specifically stated.

EXAMPLE I

In this example which represents the best mode of practicing the process of this invention, the charge diesel oil is characterized by the following properties:

ibp: 376° F.
50%: 512° F.
ep: 623° F.
API: 35
Pensky Martin Flash Point: 170° F.
Conductivity: 8

To 100 parts of this diesel oil, there is added 30 parts of a straight run naphtha having the following properties:

ibp: 130° F.
50%: 178° F.
ep: 318° F.
API: 74
COC Flash Point: <70° F.
Conductivity: 6

The mixture is found to have a COC flash point of <70° F. and a conductivity of 7 units.

There is added to this extended diesel oil 0.5 parts of a mixture of pentanols, as a conductivity additive, containing the following:

| Component | Parts |
|---|---|
| 3-methyl-1-butanol | 0.425 |
| 2-methyl-1-butanol | 0.075 |

The so-prepared composition may be found to have the following properties:

ibp: 130° F.
50%: 411° F.
ep: 623° F.
API: 47
COC Flash Point: <70° F.
Conductivity: 15

EXAMPLE II*

In this control Example, the formulation is exactly as in Example I except no pentanols are added.

The conductivity is 7 units.

From inspection of Example I and II*, it is apparent that the conductivity of the fuel is desirably almost doubled-an increase of from 7 up to 15 units. This indicates a substantial reduction in the propesity to generate static electricity during handling; and a resulting increase in safety.

Results comparable to Example I may be attained if the conductivity additive is:

| Example | Conductivity Additive |
|---|---|
| III | 3-methyl-1-butanol |
| IV | 2-methyl-1-butanol |
| V | Crude fusel oil having the following composition: |
| | 62.9% 3-methyl-1-butanol |
| | 11.1% 2-methyl-1-butanol |
| | 20% isobutanol |
| | 4% n-propanol |
| | 1.7% ethanol |
| | 0.2% water |
| | 0.1% other |
| VI | Refined Fusel Oil having the following composition: |
| | 68.0% 3-methyl-1-butanol |
| | 12.0% 2-methyl-1-butanol |
| | 19.9% n-butanol |
| | 0.1% other |
| VII | Refined Amyl alcohol having the following composition: |
| | 85% 3-methyl-1-butanol |
| | 15% 2-methyl-1-butanol |

Results comparable in Example I may be attained if the base oil is:

| Example | Base Oil | |
|---|---|---|
| VIII | Heavy Diesel oil having the following properties: | |
| | IBP | 410° F. |
| | 50% | 557° F. |
| | EP | 723° F. |
| | API | 48 |
| | PM Flash Point 212° F. | |
| IX | LC Gas oil having the following properties: | |
| | IBP | 364° F. |
| | 50% | 489° F. |
| | EP | 584° F. |
| | API | 30.4 |
| | PM Flash Point 155° F. | |

Although this invention has been illustrated by reference to specific embodiments, it will be apparent to those skilled in the art that various changes and modifications may be made which clearly fall within the scope of this invention.

I claim:

1. The method of increasing the conductivity of a single phase extended hydrocarbon fuel heavier than gasoline which comprises mixing (i) an extended hydrocarbon fuel heavier than gasoline and (ii) a conductivity-improving amount of 0.01–5 parts, per 100 parts of base fuel, of as a conductivity additive, at least one pentanol selected from the group consisting of 3-methyl-1-butanol and 2-methyl-1-butanol thereby forming a single phase high conductivity hydrocarbon fuel heavier than gasoline; and recovering said single phase high conductivity hydrocarbon fuel heavier than gasoline.

2. The method of increasing the conductivity of an extended hydrocarbon fuel heavier than gasoline as claimed in claim 1 wherein said fuel is a diesel fuel.

3. The method of increasing the conductivity of an extended hydrocarbon fuel heavier than gasoline as claimed in claim 1 wherein said fuel is a fuel oil.

4. The method of increasing the conductivity of an extended hydrocarbon fuel heavier than gasoline as claimed in claim 1 wherein said extended fuel has a conductivity of 1–7 pS/m.

5. The method of increasing the conductivity of an extended hydrocarbon fuel heavier than gasoline as claimed in claim 1 wherein said high conductivity fuel has a conductivity of 12–80 pS/m.

6. The method of increasing the conductivity of an extended hydrocarbon fuel heavier than gasoline as claimed in claim 1 wherein said pentanol is a commercial amyl alcohol.

7. The method of increasing the conductivity of an extended hydrocarbon fuel heavier than gasoline as claimed in claim 1 wherein said pentanol is a fusel oil.

8. The method of increasing the conductivity of an extended hydrocarbon fuel heavier than gasoline as claimed in claim 1 wherein said pentanol is a crude fusel oil.

9. The method of increasing the conductivity of an extended hydrocarbon fuel heavier than gasoline as claimed in claim 1 wherein said pentanol is a refined fusel oil.

10. The method of increasing the conductivity of single phase extended diesel oil which comprises mixing (i) an extended diesel oil and (ii) a conductivity-improving amount of 0.01–5 parts per 100 parts of diesel oil, of at least one pentanol selected from the group consisting of 3-methyl-1-butanol and 5-methyl-1-butanol thereby forming a single phase high conductivity diesel oil product; and recovering said single phase high conductivity diesel oil product.

11. The method of increasing the conductivity of a single phase hydrocarbon base diesel oil which has been extended by a petroleum naphtha which comprises mixing said hydrocarbon base diesel oil which has been extended by a petroleum naphtha and, per 100 parts of hydrocarbon base diesel oil, 0.01–5 parts of a fusel oil thereby forming a single phase high conductivity diesel oil product.

* * * * *

UNITED STATES PATENT AND TRADEMARK OFFICE

CERTIFICATE OF CORRECTION

PATENT NO. : 4,539,014

DATED : 3 September 1985

INVENTOR(S) : William M. SWEENEY

It is certified that error appears in the above-identified patent and that said Letters Patent is hereby corrected as shown below:

Column 5, line 44, correct the spelling of "propensity".

Column 8, line 1, "5-methyl-1-butanol" should read --2-methyl-1-butanol--

Column 8, last line, cancel the period, and add --; and recovering said high conductivity diesel oil product. --

Signed and Sealed this

*Thirty-first* Day of *December 1985*

[SEAL]

*Attest:*

DONALD J. QUIGG

*Attesting Officer*

*Commissioner of Patents and Trademarks*